US009232836B1

(12) United States Patent
Zaccaro et al.

(10) Patent No.: US 9,232,836 B1
(45) Date of Patent: Jan. 12, 2016

(54) SHADE DEVICE

(71) Applicants: Jeffrey T. Zaccaro, Lake Forest, CA (US); Michael J. Zaccaro, Trabuco Canyon, CA (US)

(72) Inventors: Jeffrey T. Zaccaro, Lake Forest, CA (US); Michael J. Zaccaro, Trabuco Canyon, CA (US)

( * ) Notice: Subject to any disclaimer, the term of this patent is extended or adjusted under 35 U.S.C. 154(b) by 0 days.

(21) Appl. No.: 14/522,424

(22) Filed: Oct. 23, 2014

(51) Int. Cl.

| | |
|---|---|
| ***A45B 17/00*** | (2006.01) |
| ***A45B 23/00*** | (2006.01) |
| ***A45F 3/44*** | (2006.01) |
| ***E02D 5/80*** | (2006.01) |
| *E04H 12/22* | (2006.01) |

(52) U.S. Cl.
CPC ..... *A45B 23/00* (2013.01); *A45B 17/00* (2013.01); *A45F 3/44* (2013.01); *E02D 5/80* (2013.01); *A45B 2023/0018* (2013.01); *A45B 2023/0037* (2013.01); *E04H 12/2215* (2013.01)

(58) Field of Classification Search
CPC ..... E04H 12/2215; E04H 12/2223; E04H 12/2238; E04H 12/2246; A45B 17/00; A45B 23/00; A45B 2023/0012; A45B 2023/0018; A45B 2023/0037; A45F 3/44; E02D 5/80
USPC ..... 135/20.1, 20.3, 21; 248/156, 530, 545, 248/519, 523; 5/418; 52/165; 404/244, 232; 403/97, DIG. 7
See application file for complete search history.

(56) References Cited

U.S. PATENT DOCUMENTS

| | | | | | |
|---|---|---|---|---|---|
| 281,675 | A | * | 7/1883 | Eichling et al. | 248/278.1 |
| 508,418 | A | * | 11/1893 | Heaney | 248/514 |
| 1,222,246 | A | * | 4/1917 | Schumacher | 248/103 |
| 1,800,349 | A | * | 4/1931 | Hurason | 403/57 |
| 3,120,238 | A | * | 2/1964 | Glatz | 135/21 |
| 3,694,978 | A | * | 10/1972 | Mintz | 52/166 |
| 3,765,434 | A | * | 10/1973 | Riggs | 135/20.1 |
| 3,922,481 | A | * | 11/1975 | Lewis | 174/146 |
| 4,034,946 | A | * | 7/1977 | Zimmer, Jr. | 248/183.2 |
| 4,184,783 | A | * | 1/1980 | Hall | 403/157 |
| 4,249,712 | A | * | 2/1981 | DeLong | 248/118 |
| 4,348,842 | A | * | 9/1982 | Wilkinson | 52/166 |
| 4,449,542 | A | * | 5/1984 | McSwain et al. | 135/98 |
| 4,649,678 | A | * | 3/1987 | Lamson | 52/103 |
| 5,122,014 | A | * | 6/1992 | Genfan | 405/244 |
| 5,152,495 | A | | 10/1992 | Jacinto et al. | |
| 5,156,369 | A | * | 10/1992 | Tizzoni | 248/545 |
| 5,236,213 | A | * | 8/1993 | Trickett | 280/304.1 |
| 5,396,743 | A | * | 3/1995 | Bellette | 52/154 |
| 5,396,915 | A | * | 3/1995 | Bomar | 135/16 |
| 5,396,916 | A | | 3/1995 | Boissonnault | |
| D370,336 | S | * | 6/1996 | Rosier | D3/5 |
| 5,547,305 | A | * | 8/1996 | Treche | 403/97 |
| 5,588,630 | A | * | 12/1996 | Chen-Chao | 248/514 |
| 5,636,944 | A | * | 6/1997 | Buttimore | 405/244 |

(Continued)

FOREIGN PATENT DOCUMENTS

| | | | | |
|---|---|---|---|---|
| DE | 3229776 | A1 * | 4/1983 | A45B 23/00 |

*Primary Examiner* — Robert Canfield
(74) *Attorney, Agent, or Firm* — Eric Karich; Karich & Associates

(57) ABSTRACT

A shade device has a canopy mounted on a collapsible frame which is supported by a lateral support tube and an upright support tube. The collapsible frame supports the canopy in either up open configuration or a closed configuration, and includes a central support structure. The lateral support tube is attached to the central support structure above the canopy, and extends to approximately over the outer perimeter of the canopy. The upright support tube is attached to the lateral support tube and includes mounting device for mounting the upright support tube in or on the ground surface.

7 Claims, 4 Drawing Sheets

(56) References Cited

U.S. PATENT DOCUMENTS

| | | | | |
|---|---|---|---|---|
| 5,662,304 | A | 9/1997 | McDaniel | |
| 5,775,184 | A * | 7/1998 | Cole | 81/60 |
| 5,937,881 | A * | 8/1999 | Villa | 135/20.1 |
| 6,209,835 | B1 * | 4/2001 | Walrath et al. | 248/276.1 |
| 6,220,261 | B1 * | 4/2001 | Glatz | 135/20.3 |
| 6,619,872 | B2 * | 9/2003 | Crorey et al. | 403/97 |
| 6,715,503 | B2 | 4/2004 | Brooks, III | |
| 7,367,740 | B2 * | 5/2008 | Lazic et al. | 403/97 |
| 7,520,485 | B1 | 4/2009 | Giannetto | |
| 7,958,901 | B2 | 6/2011 | Lai | |
| 8,082,934 | B1 * | 12/2011 | Kucinski | 135/16 |
| 8,104,492 | B2 | 1/2012 | Dan | |
| 2004/0089777 | A1 * | 5/2004 | Schilt et al. | 248/227.2 |
| 2004/0177871 | A1 | 9/2004 | Harbaugh | |
| 2005/0056751 | A1 * | 3/2005 | Slatter | 248/288.11 |
| 2005/0229959 | A1 * | 10/2005 | Lin | 135/21 |
| 2006/0097117 | A1 * | 5/2006 | Yu | 248/156 |
| 2006/0272687 | A1 * | 12/2006 | Tanner et al. | 135/16 |
| 2007/0209688 | A1 * | 9/2007 | Earnshaw | 135/16 |
| 2008/0142058 | A1 * | 6/2008 | Chan | 135/20.1 |
| 2012/0180832 | A1 * | 7/2012 | Zheng | 135/20.1 |
| 2013/0146739 | A1 | 6/2013 | Zhao | |
| 2014/0230866 | A1 | 8/2014 | Paolucci | |
| 2014/0373461 | A1 * | 12/2014 | Rodriguez | 52/170 |
| 2015/0060631 | A1 * | 3/2015 | Pan | 248/523 |

* cited by examiner

SHADE DEVICE

BACKGROUND OF THE INVENTION

1. Field of the Invention

This invention relates generally to shade devices, and more particularly to a shade device that is portable and includes an offset umbrella that is particularly adapted for personal use by a single person requiring a small amount of shade.

2. Description of Related Art

The prior art teaches a wide range of umbrellas, for a variety of uses. One form of umbrella, known as an offset umbrella, is a large form of umbrella typically used for shading patio areas. The offset umbrella includes a support post on the side of the canopy, and a lateral extension that extends over the patio to support the canopy. Offset umbrellas typically require large and heavy bases to offset the weight of the canopy, and prevent the offset umbrella from tipping over.

Offset umbrellas are especially unwieldy and cumbersome, and tend to get knocked over even in moderate winds, despite large and heavy bases. Because of their unwieldy construction, and heavy bases, offset umbrellas are not typically thought of as portable, although some versions can be moved around a space (e.g., a patio). The prior art does not teach an offset umbrella that could be taken to an outdoor location (e.g., a beach) for personal use. Indeed, the prior art teaches against such a use for this type of umbrella, because offset umbrellas are particularly known to be large, heavy, unwieldy, and cumbersome.

U.S. Pat. No. 7,958,901, Lai describes one prior art version of such an offset umbrella. This offset umbrella includes an upright post, a swing mechanism pivotally mounted on the upright post, a frame mounted on the swing mechanism to pivot in concert with the swing mechanism relative to the upright post, and a weighted base for supporting the swing mechanism. Lai is a good example of an offset umbrella such as would be used on a patio; and it would not be realistically possible to carry the Lai umbrella to a beach or similar location for personal use by a person (e.g., sunbather).

US 2013/0146739, Zhao teaches another example of an offset umbrella base that includes a base that is adapted to be heavily weighted. One or more identical sector-shaped base boxes are provided in the base that can be filled with heavy filling material (e.g., sand). The sector-shaped base boxes are attached to each other and placed on a formation of elongated base members of an umbrella to hold the umbrella in an upright position. Even if the fill material is removed, a difficult and time consuming process, the base is still too large to be readily portable, and the Zhao umbrella would never to suitable for a trip to the beach, or similar excursion. Other examples of offset umbrellas include Dan, U.S. Pat. No. 8,104,492, and Harbaugh, US 20040177871, which are similar in general construction.

The prior art also teaches a wide variety of standard umbrellas, that include an upright post that extends to the middle of a canopy. Since these standard umbrellas are more stable, they can be made without the heavy bases used in offset umbrellas, and are thus far more portable. These umbrellas include a wide range of bases, including various screw devices for screwing the post of the umbrella into the ground. Good examples of standard umbrellas with screw mounts are shown in U.S. Pat. No. 6,715,503, and U.S. Pat. No. 5,152,495.

U.S. Pat. No. 5,396,916, Boissonnault teaches a unique shading device including an umbrella-like canopy that includes a collapsible frame and a flexible light-proof covering. The device includes an anchoring device that includes an anchoring helix adapted to be driven into the ground. The frame of the device can be adjusted to lean outwardly in a cantilever; however, it extends upwardly to the center of the canopy, in a manner similar to standard umbrellas.

The above-described references are hereby incorporated by reference in full.

The prior art teaches offset umbrellas that include heavy bases and that are not readily portable; and the prior art teaches standard umbrellas that are more portable. However, the prior art does not teach an offset umbrella that is readily portable and usable by an individual for personal shade (e.g., while at the beach, etc.). The present invention fulfills these needs and provides further advantages as described in the following summary.

SUMMARY OF THE INVENTION

The present invention teaches certain benefits in construction and use which give rise to the objectives described below.

The present invention provides a shade device. The shade device includes a canopy mounted on a collapsible frame which is supported by a lateral support tube and an upright support tube. The canopy has an upper surface and a lower surface, which extends from a center to an outer perimeter. The collapsible frame supports the canopy in either up open configuration or a closed configuration, and includes a central support structure for supporting the canopy. The lateral support tube has a proximal end and a distal end, wherein the distal end is attached to the central support structure above the canopy, and wherein the proximal end extends, when the canopy is in the open configuration, to approximately over the outer perimeter of the canopy. The upright support tube includes an upper end and a lower end, wherein the upper end is attached to the proximal end of the lateral support tube for supporting the canopy above the ground surface. A mounting device on the lower end of the upright support tube mounts the upright support tube in or on the ground surface.

A primary objective of the present invention is to provide a shade device having advantages not taught by the prior art.

Another objective is to provide a shade device that is easily portable to remote locations, and may be easily set up, taken down, and carried by a single person with little effort.

A further objective is to provide a shade device that provides a small amount of shade to an individual user.

A further objective is to provide a shade device that is small enough to remain stable in moderate winds, even without the use of a large or heavy base.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a shade device 10 that is adapted to be removably mounted in or on a ground surface 12 for providing shade to a user. The shade device 10 is of unusually small and uniquely portable construction that is easily taken to remote locations, such as a beach, where the shade device 10 may be easily configured for use by the individual use of the user. The shade device 10 is particularly suited for personal use, and provides shade to a relatively small area (e.g., just covering the user's head 16), in furtherance of the unique portability of the shade device 10.

Figure 1:
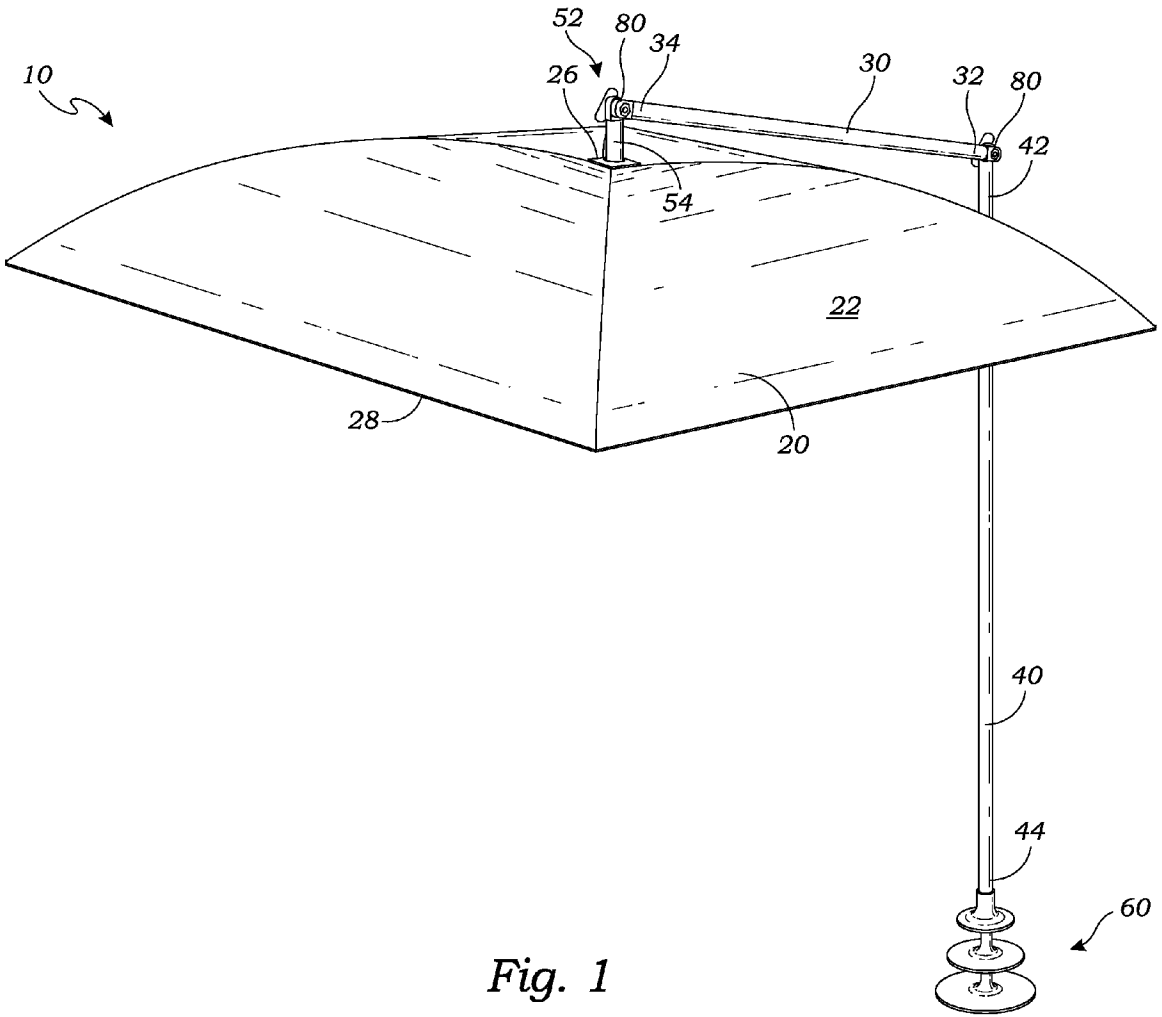
FIG. 1 is a perspective view of a shade device according to one embodiment of the present invention.

FIG. 1 is a perspective view of the shade device 10 according to one embodiment of the present invention. As shown in FIG. 1, the shade device 10 includes a canopy 20 which is supported by a lateral support tube 30 and an upright support tube 40. The canopy 20 is formed by a sheet of material (e.g., fabric, sheet plastic, etc.) that can open to provide shade to the user. The general construction of such canopies is known in the art, but one embodiment of such a canopy is discussed in greater detail below in reference to FIG. 2. A central support structure 52 at a center 26 of the canopy 20 provides a mounting point for attaching the canopy 20 to the lateral support tube 30.

In the embodiment of FIG. 1, the lateral support tube 30 that has a proximal end 32 that is attached to the upright support tube 40, and a distal end 34 that is attached to the central support structure 52 of the canopy 20. The lateral support tube 30 is of generally known construction, such as tubular steel, aluminum, plastic, or similar material known in the art, although in this application the term "tube" is hereby defined to include any form of rigid tube, rod, beam, arm, or similar construction known in the art for this type of structure.

In this embodiment, the lateral support tube 30 is positioned above an upper surface 22 of the canopy 20, with the lateral support tube 30 being positioned to extend across the canopy 20, in a generally radial position, such that when the canopy 20 is in an open configuration, the proximal end 32 is approximately over an outer perimeter 28 of the canopy 20 (although it may be somewhat shorter or longer, depending upon the particular design of the shade device 10). In this embodiment, the lateral support tube 30 is slightly longer than a radius of the canopy 20.

In the embodiment of FIG. 1, the upright support tube 40 includes an upper end 42 and a lower end 44. The upper end 42 is attached to the proximal end 32 of the lateral support tube 30 for supporting the canopy 20 above the ground surface 12. As discussed above, the upright support tube 40 may be of any form of construction that is suitable for this form of shade device, in the present embodiment being constructed of tubular steel.

The shade device 10 further includes a mounting device 60 on the lower end 44 of the upright support tube 40 for mounting the upright support tube 40 in or on the ground surface 12. The mounting device 60 is discussed in greater detail below with reference to FIGS. 3-4.

Figure 2:
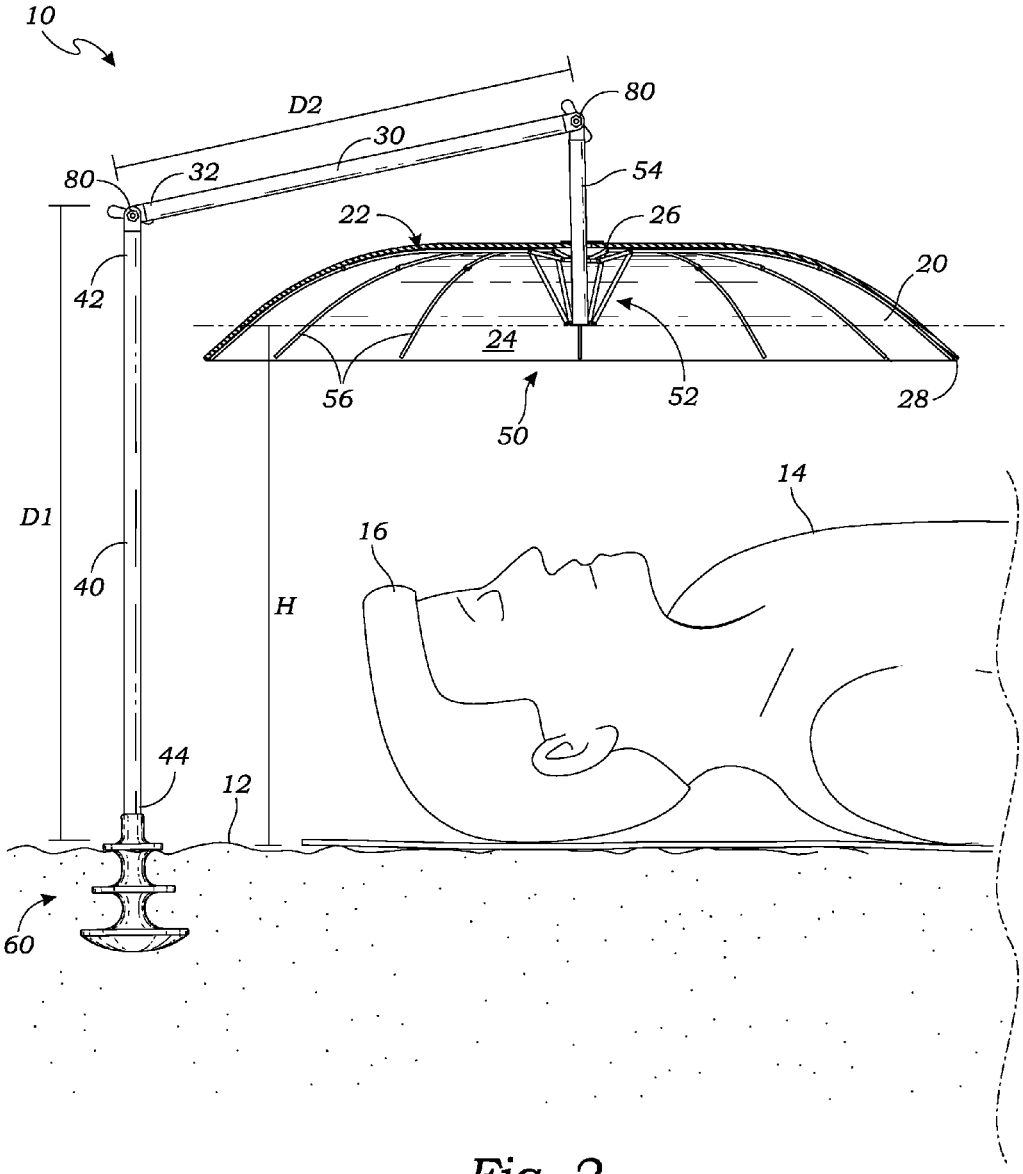
FIG. 2 is a side elevational view of the shade device mounted in a ground surface for shading a user, the shade device being shown partially in section to illustrate a collapsible frame of the shade device.

FIG. 2 is a side elevational view of the shade device 10 mounted in the ground surface 12 for shading a user 14, the shade device 10 being shown partially in section to illustrate a collapsible frame of the shade device 10. As shown in FIG. 2, the canopy 20 has the upper surface 22 (shown in FIG. 1) and a lower surface 24, which extend from the center 26 to an outer perimeter 28. A collapsible frame 50 supports the canopy 20 in either an open configuration or a closed configuration. The general structure of the collapsible frame 50 is similar to known umbrella structures, and is therefore not described in greater detail herein.

In this embodiment, the collapsible frame 50 has the central support structure 52 discussed above for supporting the canopy 20. In this embodiment, the central support structure 52 includes a central tube 54 (or equivalent attachment point) that extends above the canopy 20 so that the lateral support tube 30 can be attached above the canopy 20.

As shown in FIG. 2, the shade device 10 is small in construction, much smaller than typical offset umbrellas, thus obviating a need for a heavy and bulky base construction. In this embodiment, the upright support tube 40 extends a first distance D1 that is less than 4 feet in length, in this case less than 3 feet in length. The typical first distance D1 is between 1-3 feet, preferably about 2 feet, depending upon the selection of the designer. For purposes of this application, the term "about" is defined to mean+/−10%.

Similarly, the lateral support tube 30 extends a second distance D2 that is less than 3 feet in length, in this case less than 1.5 feet in length. The typical second distance D2 is 1-2 feet, or about 1.2 feet, depending upon the selection of the designer.

The canopy 20 typically has a diameter that is less than 4 feet, more commonly less than 3 feet in diameter (between 1-3 feet), although this can be determined by those skilled in the art.

The first distance D1 and the second distance D2, and the relative orientations of the lateral support tube 30 and the upright support tube 40, determine a height H of the canopy 20, or more particularly, the distance from the central support structure 52 and the ground surface 12. The height H is less than 4 feet, in this case less than 3 feet, most commonly about 1.5-2.0 feet. This height H is significantly and notably different than prior art offset umbrellas, which are typically more than 6 feet above the ground.

Figure 5:
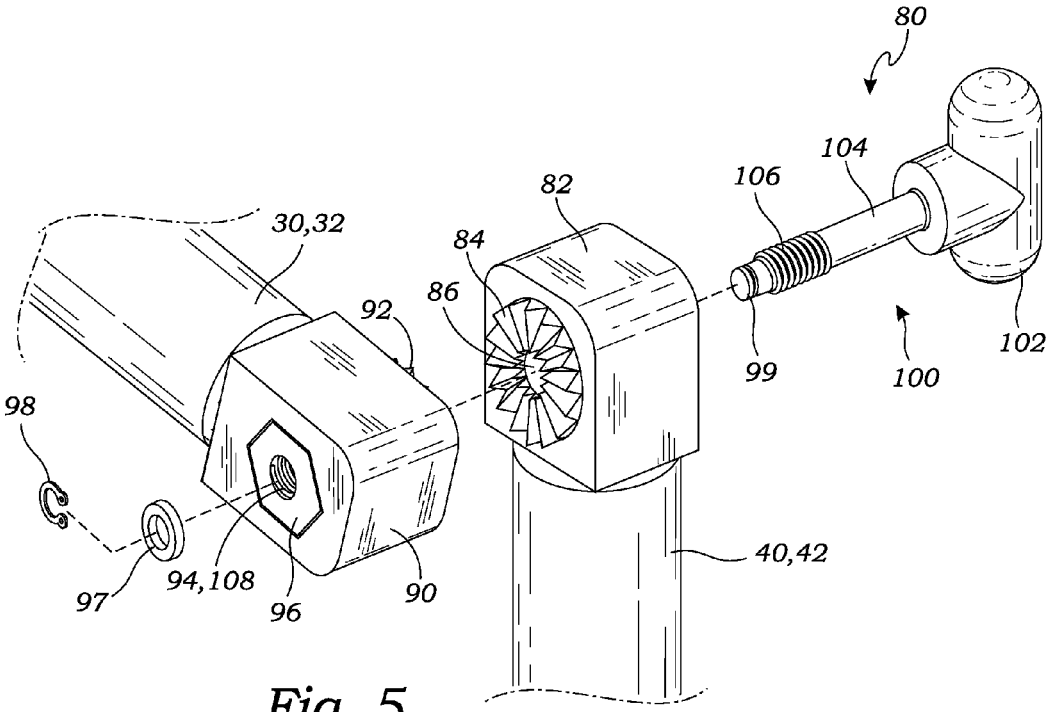
FIG. 5 is an exploded perspective view of a locking pivot used in one embodiment of the shade device.
Figure 6:
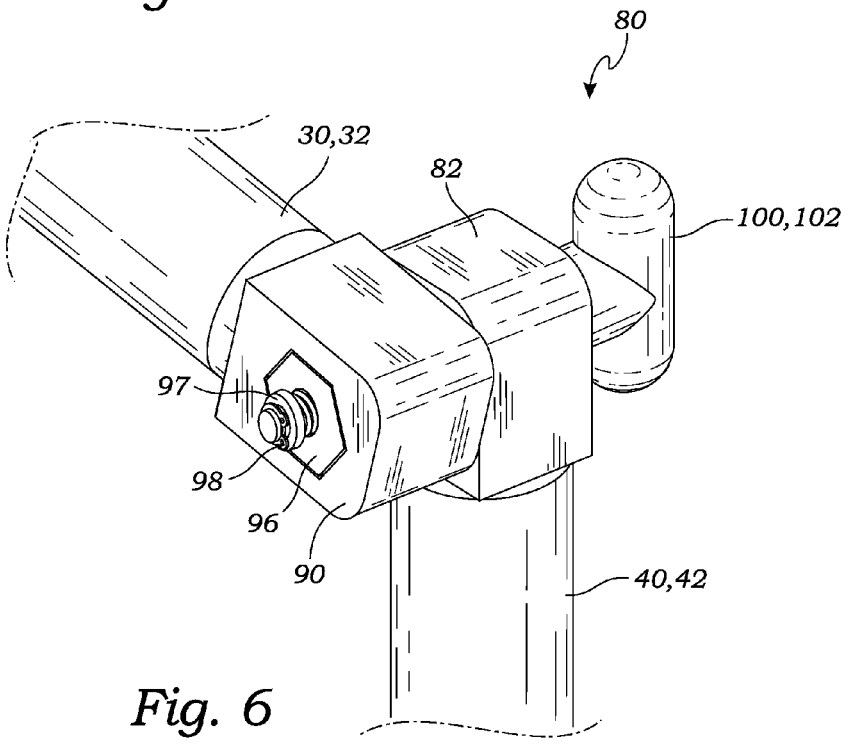
FIG. 6 is a perspective view thereof once the locking pivot is assembled.

As shown in FIGS. 1 and 2, the upright support tube 40 is pivotally connected to the lateral support tube 30, in this case with a locking pivot 80 that is shown in FIGS. 5-6, and discussed in greater detail below. A similar locking pivot 80 may also be used to attach the lateral support tube 30 with the central tube 54, so that the relative positions of these support structures may be varied with respect to each other, to adjust the position of the canopy 20 with respect to the user 14 and with respect to the ground surface 12. This aspect of the invention is discussed in greater detail below. While the locking pivot 80 is one embodiment of how this pivotal connection may be made, other forms of connections and/or pivoting structures may also be used, and such alternatives should be considered within the scope of the present invention, unless the claim language explicitly recites these limitations.

As shown in FIGS. 1 and 2, the upright support tube 40 includes a mounting device 60 for removably mounting the shade device 10 in or on a ground surface 12. One embodiment of the mounting device 60 is illustrated in FIGS. 3-4, which is discussed in greater detail below.

Figure 3:
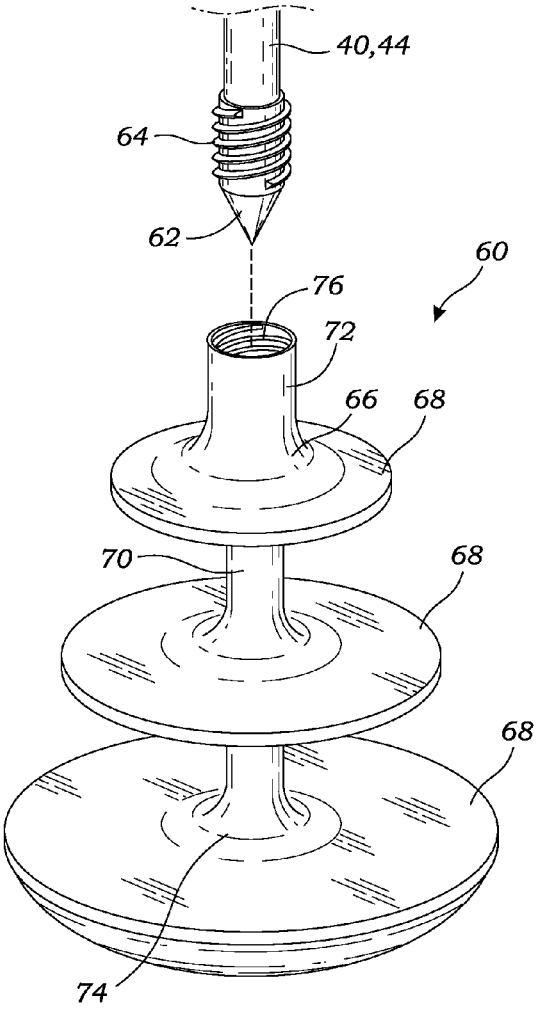
FIG. 3 is an exploded perspective view of one embodiment of a mounting device of the shade device.

FIG. 3 is an exploded perspective view of one embodiment of the mounting device 60 shown in FIGS. 1 and 2. FIG. 4 is an exploded side elevational view thereof. As shown in FIGS. 3 and 4, in this embodiment the mounting device 60 comprises a pointed tip 62 formed in the lower end 44 of the upright support tube 40. The pointed tip 62 may further include a mounting thread 64 adjacent for threadedly engaging a covering element such as a sand anchor 66. In this embodiment, the sand anchor 66 includes a plurality of plates 68 that are arranged in a stack concentrically mounted on a central shaft 70 having a top end 72 and a bottom end 74. The central shaft 70 may include an internally threaded receiver 76 that is shaped to threadedly receive the pointed tip 62 and the mounting thread 64 for mounting the sand anchor 66 over the pointed tip 62.

Figure 4:
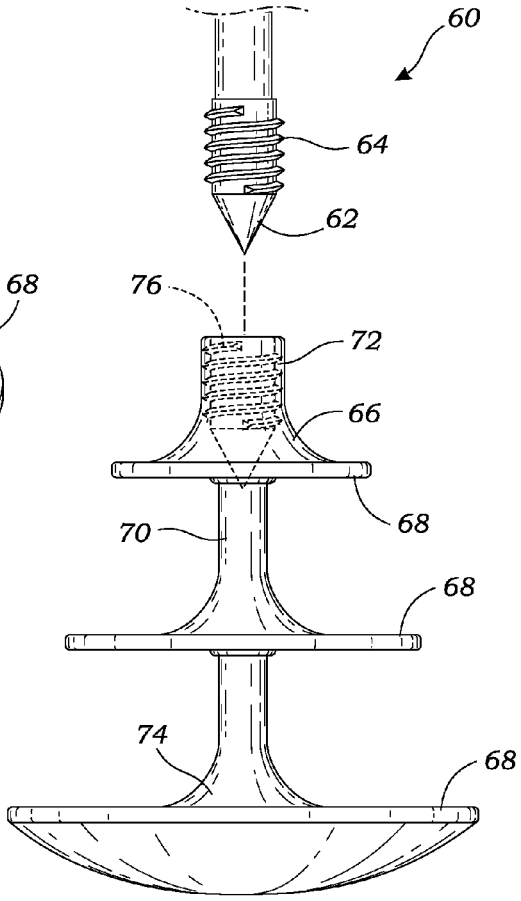
FIG. 4 is an exploded side elevational view thereof.

While the embodiment illustrated in FIGS. 3-4 represents one form of the mounting device 60, those skilled in the art may devise alternative forms of mounting device 60, including those devices shown in the prior art cited above, and such alternative and/or equivalent structures should be considered within the scope of the present invention, unless the claim specifically requires particular limitations described above.

As mentioned above, locking pivots 80 may be used to connect various components of the shade device 10. FIG. 5 is an exploded perspective view of one embodiment of the locking pivot 80, and FIG. 6 is a perspective view thereof once the locking pivot 80 is assembled. As shown in FIGS. 5-6, the locking pivot 80 includes a first pivot head 82 having a first interlocking structure 84 and a first aperture 86, a second pivot head 90 having a second interlocking structure 92 and a second aperture 94, and a locking knob 100 for connecting the first and second pivot heads 82 and 90. The first and second interlocking structures 84 and 92 are mating structures (e.g., teeth, grooves, gears, etc.) that lock when brought together, to prevent rotation of the first and second pivot heads 82 and 90 with respect to each other.

In this embodiment, the locking knob 100 includes having a knob head 102 that enables the user to grasp and rotate the locking knob 100 for tightening or loosening the locking pivot 80. A shaft 104 extends from the knob head 102, and includes an external thread 106 on the shaft 104. The shaft 104 extends through the first and second apertures 86 and 94 and threadedly engages an internal thread 108 for locking the first and second pivot heads 82 and 90 together such that the first and second interlocking structures 84 and 92 interlock and prevent rotation of the first pivot head 82 with respect to the second pivot head 90.

In this embodiment, the internal thread 108 is formed in a nut 96 that fits within the second pivot head 90. The locking pivot 80 may further include a locking ring 97 that is held in place with a C-clip 98 that engages a slot 99 on the end of the shaft 104. The locking ring 97 and C-clip 98 prevent the locking knob 100 from coming entirely out of the first and second pivot heads 82 and 90 when the locking pivot 80 is opened for adjusting the shade device 10.

This unique construction functions entirely differently than prior art offset umbrellas. Adjustments are made using the locking pivots 80, and the shade device 10 does not include a swing mechanism or similar construction (which is required in prior art umbrellas due to the much greater size that is typically used).

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A shade device for mounting on a ground surface, the shade device comprising:

a canopy having an upper surface and a lower surface, which extends from a center to an outer perimeter;

a collapsible frame for supporting the canopy in either up open configuration or a closed configuration, the collapsible frame having a central support structure for supporting the canopy;

a lateral support tube that has a proximal end and a distal end, wherein the distal end is attached to the central support structure above the canopy, and wherein the proximal end extends, when the canopy is in the open configuration, to approximately over the outer perimeter of the canopy;

an upright support tube that includes an upper end and a lower end, wherein the upper end is attached to the proximal end of the lateral support tube for supporting the canopy above the ground surface; and a mounting device on the lower end of the upright support tube for mounting the upright support tube in or on the ground surface;

wherein the mounting device comprises a pointed tip having a mounting thread adjacent the pointed tip;

a sand anchor having a plurality of plates that are arranged in a stack concentrically mounted on a central shaft having a top end and a bottom end, and wherein the central shaft includes an internally threaded receiver that is shaped to threadedly receive the pointed tip for mounting the sand anchor over the pointed tip.

2. The shade device of claim 1, wherein the upright support tube is less than 4 feet in length.

3. The shade device of claim 1, wherein the upright support tube is less than 3 feet in length.

4. The shade device of claim 1, wherein the lateral support tube is less than 3 feet in length.

5. The shade device of claim 1, wherein the lateral support tube is less than 1.5 feet in length.

6. The shade device of claim 1, wherein the canopy is less than 4 feet in diameter.

7. The shade device of claim 1, wherein the canopy is less than 3 feet in diameter.

* * * * *